United States Patent [19]

Homolik

[11] 4,361,131

[45] Nov. 30, 1982

[54] CIRCULATING-AIR HEATING STOVE WITH EXIT AIR HEAT EXTRACTOR

[76] Inventor: Matthew W. Homolik, 2930 Ransell Rd., Merrifield, Va. 22116

[21] Appl. No.: 181,477

[22] Filed: Aug. 26, 1980

[51] Int. Cl.[3] ..... F24B 7/00

[52] U.S. Cl. ..... 126/123; 126/61; 126/66; 126/77; 126/88

[58] Field of Search ..... 126/77, 60, 61, 123, 126/67, 121, 68, 126, 88, 65, 66; 237/55

[56] References Cited

U.S. PATENT DOCUMENTS

| | | | |
|---|---|---|---|
| 1,200,201 | 10/1916 | Kreatz | 126/121 |
| 2,362,940 | 11/1944 | Skerritt | 237/55 |
| 4,180,052 | 12/1979 | Henderson | 126/123 |
| 4,201,185 | 5/1980 | Black | 126/77 |

FOREIGN PATENT DOCUMENTS

| | | | |
|---|---|---|---|
| 242292 | 1/1961 | Australia | 126/123 |
| 1041223 | 9/1966 | United Kingdom | 237/55 |

*Primary Examiner*—James C. Yeung

*Attorney, Agent, or Firm*—Kerkam, Stowell, Kondracki & Clarke

[57] ABSTRACT

A circulating air wood burning heating stove/fireplace combination has a combustion chamber for burning fuel. The combustion chamber is in the form of a shell defined by inner walls of the stove and a rearwardly disposed air outlet manifold. Spaced outer auxiliary back and top walls and the corresponding shell walls form therebetween air passages through which ambient air is recirculated into the room over the manifold. The manifold is provided with a plurality of spaced heat conductive metal strips disposed about its periphery. An air inlet is provided at the bottom of the back air passage and an electric fan or blower is attached to the inlet to force air into the back air passage. This air then passes upwardly in the space between the back walls, over and under the air outlet manifold and past the heat conductive metal strips, through the air passage formed between the top walls which extend across the top of the fire chamber and then exits through an upper grill work provided in the front face of the stove into the space to be heated. Additional heat conductive metal strips may be provided in the top air passage connected directly to the top wall of the fire chamber to extract heat thereof and improve the heat exchange prior to discharge of the heated air into the space to be heated. A baffle is provided in the fire chamber to create turbulence and to provide a torturous path for the combustion products within the fire chamber so as to prevent the combustion gases or products from escaping directly through the inlet openings of the manifold to the flue.

11 Claims, 6 Drawing Figures

CIRCULATING-AIR HEATING STOVE WITH EXIT AIR HEAT EXTRACTOR

BACKGROUND OF THE INVENTION

With the advent of central heating systems and abundantly available and relatively inexpensive fossil fuels, old-fashioned "pot-bellied" stoves which formerly were used to provide heat have fallen into disuse. Central heating systems offer a distinct advantage over individual heating stoves located in each room which a person desires to heat. Furthermore, central heating systems can be hidden away out of view from the rooms in which they supply heat. In addition, such systems, even coal fired systems, are relatively easy to clean and to maintain. As a consequence, up until recently, there has been little interest in wood burning heating stoves, particularly those which are located within the room which is to be heated. This has been true even for remote cabins or cottages since bottled gas or petroleum fuels have been available in abundant quantities for use with the heating plants of such buildings.

At the present time, however, it is becoming abundantly clear that the fossil fuels which have been used to such a great extent over the past few decades are in dangerously short supply. Furthermore, these fuels are obtained from nonreplenishable sources; and at the present rate of consumption, it is readily apparent that other alternatives to the use of these fuels for producing energy must be found. In additon, the costs of fossil fuels are rapidly increasing, so that they no longer are the bargain source of energy which they were only a few years ago.

Because of increasing awareness of the finite quantity of fossil fuels available and because of the increasing costs of these fuels, substantial interest is being directed toward finding other sources of energy to replace the fossil fuel consumption which has become so widespread over the past few decades. One source of fuel which is present in large quantities and which is a replenishable source is wood. When forests are properly managed, they produce a continuous supply of wood for various uses, one of which is fuel.

Thus, there now is an increasing interest in wood burning stoves for heating small buildings and remote located buildings as well as interest in using wood burning stoves in applications where presently fossil fuel central heating systems are commonly employed or as a supplement to existing systems. The wood burning stoves comonly employed, however, generally are extremely inefficient as heating sources. Most of them rely upon radiation and convection currents of air within the room coming into contact with the outside walls of the stove to produce heated air. In such stoves the major portion of the heat produced by the combustion of the wood or other combustible products in the stove is lost with the combustion products out the flue or smoke stack. This is one of the greatest drawbacks of self-contained room size wood burning stoves. In addition, the room itself is not uniformly heated. The region immediately adjacent the stove is too hot, while the more remote corners or sides of the room obtain relatively little heat from the stove.

Some early models of wood burning heating stoves, in attempts to overcome the inefficiency of such stoves, relied upon rather extensive baffles between the upper portion of the combustion chamber and the outlet for the flue in order to force the combustion products to take a tortuous path from the upper portion of the combustion chamber to the flue. This resulted in retention of more heat within the stove and an improvement in radiation of this heat from the stove. The operation, however, is still relatively inefficient and a large amount of heat loss results due to hot air passing out the flue.

To improve these early wood burning stoves resort was made to a double wall along at least a portion of the fire chamber to create an air chamber heated on one side by one of the walls of the fire chamber. An air inlet was provided near the bottom of this air chamber and appropriate air outlets were created near the top. Air rose by convection current through the air chamber and out the outlets. Thus, this air was heated in addition to the air coming in contact with the outside of the stove. To improve efficiency still further, fans or blowers were employed to draw air through the air chamber and over the outer walls of the fire chamber. While the fans did provide improved efficiency, the bulk of the heat generated by the process of combustion still was lost in the flue, as could be evidenced by the fact that the flue pipe of an operating stove is generally too hot to touch.

In addition to the foregoing disadvantages, most wood burning stoves are rather obtrusive and unattractive. It is desirable to provide a wood burning stove with an appearance approximately that of a fireplace and useable as a fireplace, so that it can perform a function of attractiveness as well as utility in the room in which it is used. In addition, it is desirable to provide a wood burning stove with improved efficiency, so that the greatest portion of the heat generated by the wood or other fuel burned in the stove is utilized to heat the room in which the stove is used.

SUMMARY OF THE INVENTION

Accordingly, it is an object of this invention to provide an improved heating stove or space heater.

It is another object of this invention to provide an improved heat extractor for a heating unit.

It is an additional object of this invention to provide an improved wood burning heating stove utilizing recirculating air flow therethrough.

It is a further object of this invention to provide an improved wood burning heating stove which may be used as a stove or as a fireplace.

It is yet another object of this invention to provide an improved efficiency heat extractor adapted to be disposed to recapture heat which would otherwise escape through the flue of a heating system.

In accordance with a preferred embodiment of this invention, a wood burning heating stove has a combustion chamber with the back wall spaced inwardly from the ends of the bottom, top and side walls. An auxiliary back is spaced from the back wall of the combustion chamber and is attached to the top, bottom and side walls to provide an airspace between the two walls for the passage of air to be heated from an inlet near the bottom of the airspace. An auxiliary top wall is spaced from the top wall of the combustion chamber and is attached to the side walls to provide an airspace between the two walls for the passage of air to be exited into the space to be heated through an open grill work in the front wall of the stove. An air outlet manifold having one or more combustion air inlet openings in communication with the fire chamber and an exit opening in communication with the flue pipe or chimney for the stove is attached to the back top and side walls of the fire chamber. The air outlet manifold includes a plurality of spaced heat extractors positioned in the path of the air drawn in from the inlet and serves to heat the air prior to its exiting into the space to be heated. A large opening is provided in the front wall of the combustion chamber to permit the loading of wood or other fuel into the stove, and this opening is closed by a door which is pivotally hinged at one side of the opening. A baffle is provided at the top rear of the fire chamber to create turbulence in the combustion products rising upwardly. An electric fan or blower is used to move air through the opening in the air chamber at the rear of the stove, over and about the manifold and its heat extractors and through the uppermost air space into the space to be heated.

DETAILED DESCRIPTION OF THE INVENTION

Figure 1:
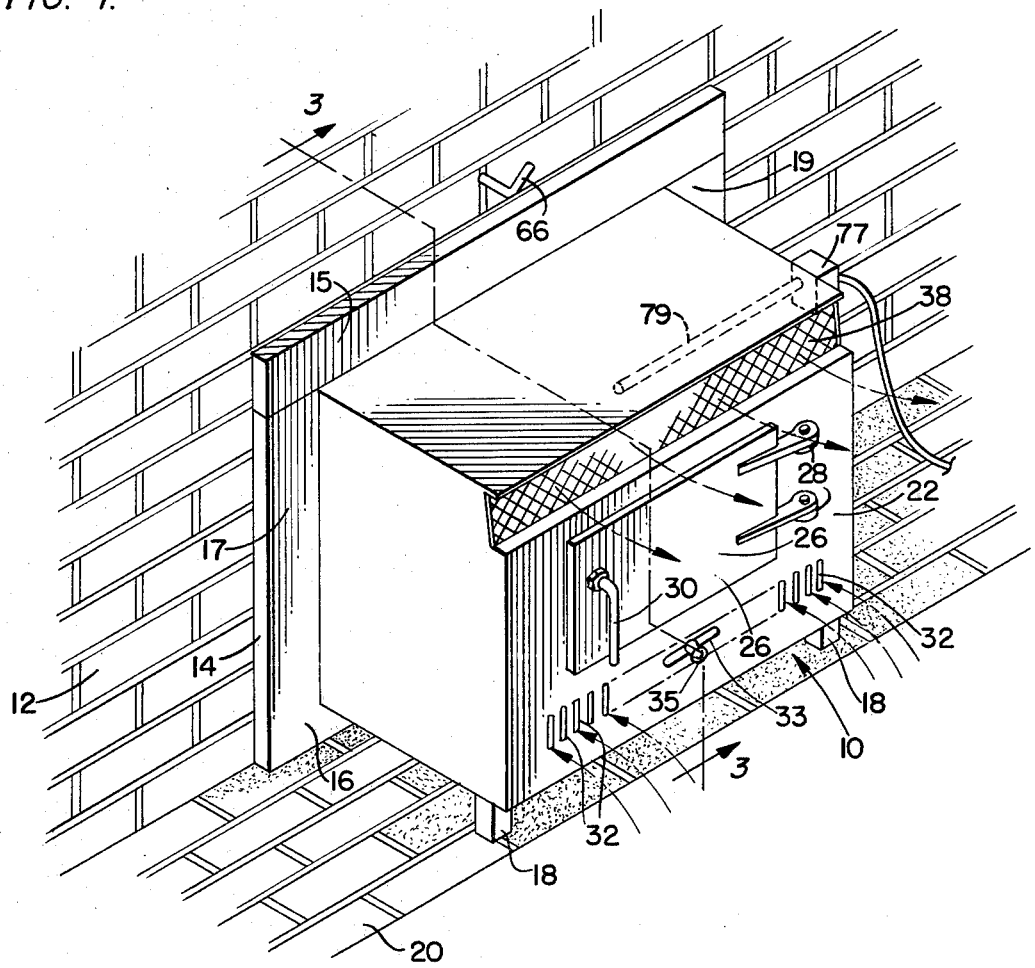
FIG. 1 is a perspective view of a preferred embodiment of the invention shown as mounted directly into a conventional fireplace opening.

Referring now to the drawings, wherein like reference characters are used to represent like elements throughout the several views, FIG. 1 is a perspective view of a preferred embodiment of space heater in accordance with the present invention which may be either of a free standing variety or used in combination with an existing fireplace.

In FIG. 1, the stove or space heater 10 is shown in use with an existing fireplace and is mounted in the suitable opening in fireplace wall 12 which is closed off by decorative frame member 14 made up of horizontal cross pieces 15 and 16 and vertical pieces 17 and 19. Frame member 14 has a rectangular opening corresponding to the outer dimension of stove 10 so that stove 10 may be conveniently positioned therein when used in conjunction with an existing fireplace opening. To this end, the bottom of the stove 10 may rest on the top edge of horizontal cross piece 16 of decorative number 14, while two front foot members 18 at the front corners of stove 10 serve to maintain the stove level with respect to hearth 20. Stove 10, as shown in FIG. 1, is shown extended substantially from the fireplace opening covered by decorative number 14; however, it will be readily appreciated that stove 10 can be inserted substantially its entire length into the fireplace opening, depending upon the depth of the fireplace, and if necessary, stove 10 may include additional foot stabilizing members at the rear thereof so that the stove may be free standing and used apart from a fireplace.

Figure 3:
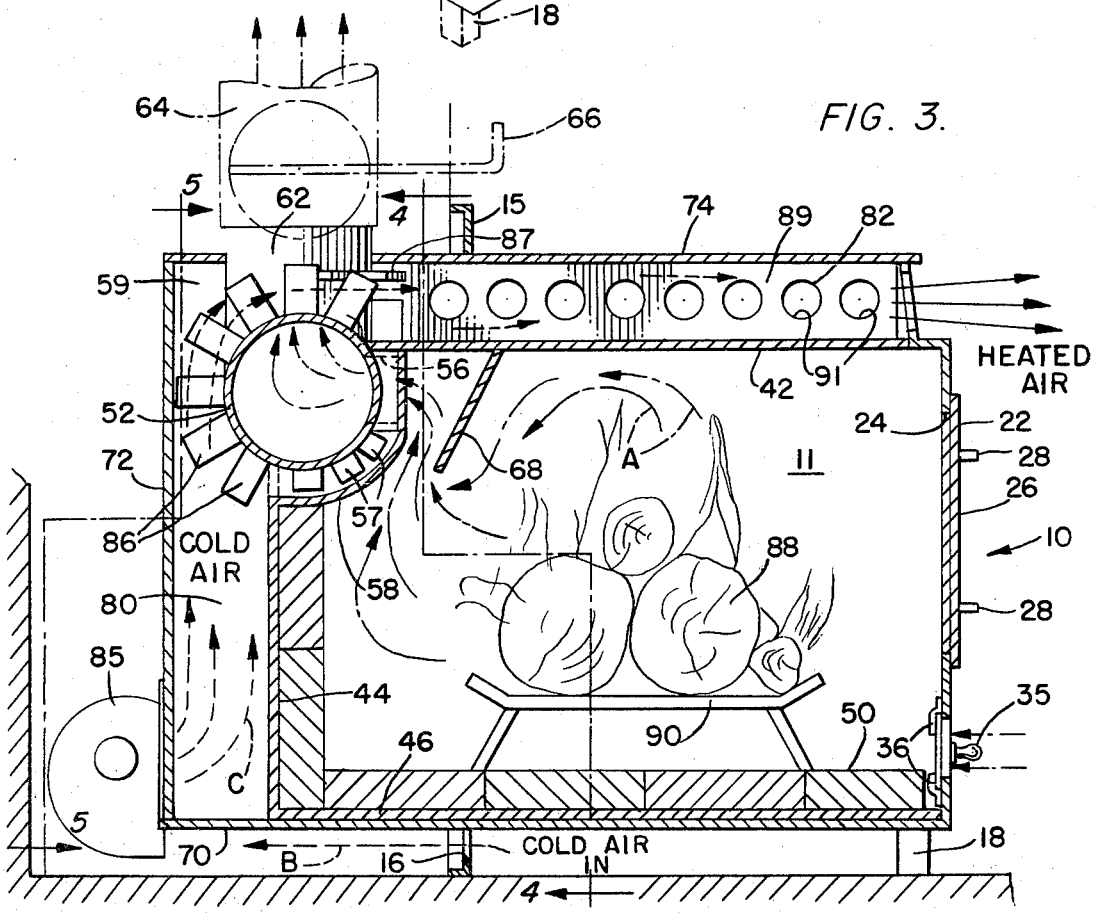
FIG. 3 is a side elevational view taken along lines 3—3 of FIG. 1.

The front wall 22 of stove 10 includes a large rectangular opening 24 defined therein (as shown most clearly in FIG. 3) which is adapted to be closed by door 26. The opening 24 provides ready access to the interior of the combustion chamber 11 to permit the loading of wood or other fuel into the combustion chamber and to permit the removal of residual products of combustion and the cleaning of the combustion chamber from time to time. Door 26 is conveniently pivotaly hinged at one side of the opening to the front wall 22 by hinges 28. At the other side of door 26 there is provided a handle 30 which preferably is of non-conductive material or includes an insulative portion to minimize the possibility of one getting burnt when handling the door during operation of the stove.

Below door 26 there is provided a plurality of spaced draft openings 32 which extend along a common line and which open into the front interior of combustion chamber 11. Draft openings 22 allow fresh air, as shown by arrows in FIG. 1, to be drawn into the combustion chamber 11. To control the draft, a slide 34 (shown in FIG. 3) is disposed behind slots 32. Slide 34 may be provided with spaced slots (not shown) adapted to be aligned with slots 32 to permit communication between the combustion chamber and outside of the stove when the slots are aligned. To this end, slide 34 includes a gripping handle or knob 35 which extends through slot 33. Slide 34 is slidingly supported within support cleats 36 welded to the inside surface of wall 22. Other draft configurations may likewise be used. For example, slide 34 may be disposed on the exterior of front wall or may be in circular in shape, it only being necessary that a convenient means be provided to allow draft air to enter into the combustion chamber and to control the amount of draft air thus entering. The amount of air permitted to enter the combustion chamber when a unit 10 is used as a heating stove or space heater is controlled by the extent of opening of the draft slots and the slide should be capable of maintaining the slots fully closed, fully open or at some intermediary position.

The combustion chamber 11 is defined by base 40, top wall 42, front wall 22, rear wall 44 and side walls 46 and 48. To prevent excess heat from being radiated from the bottom of stove 10, refractory brick or other suitable refractory material 50 is used to line the bottom of the stove and the lower portion of the side walls and back walls. The use of the refractory material 50 permits the stove unit to be built as a low profile unit which may be placed on or very near the floor of the room in which the stove is used.

Figure 2:
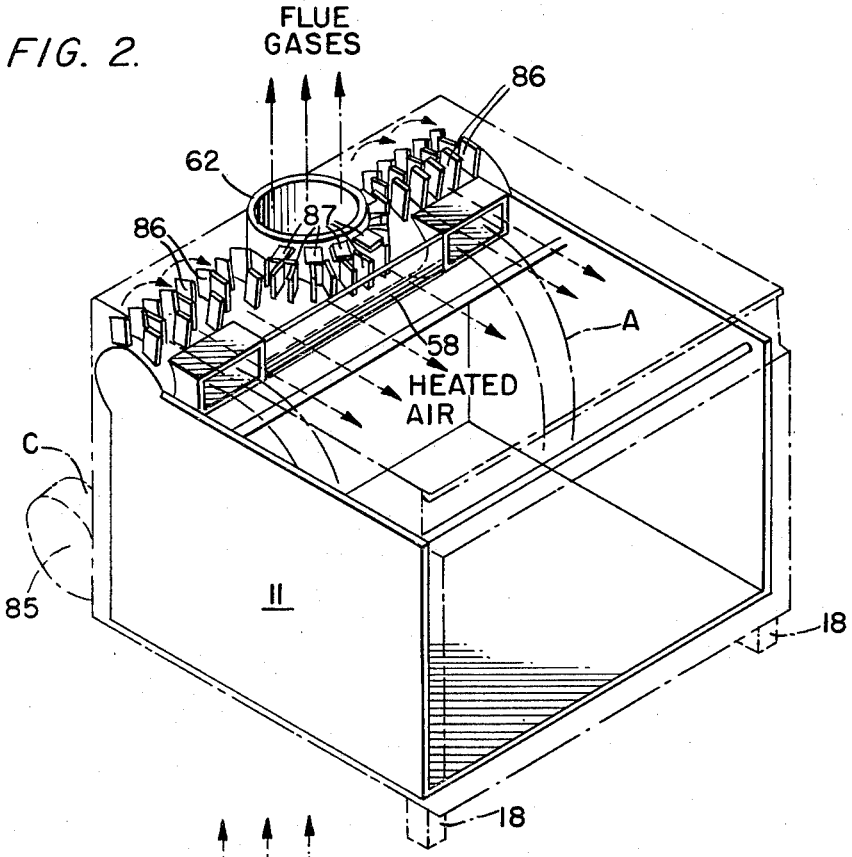
FIG. 2 is a diagrammatical perspective view of the preferred embodiment of the invention with the outer walls shown in phantom and illustrating the direction of flow of the input cold air, heated air and flue gasses.
Figure 4:
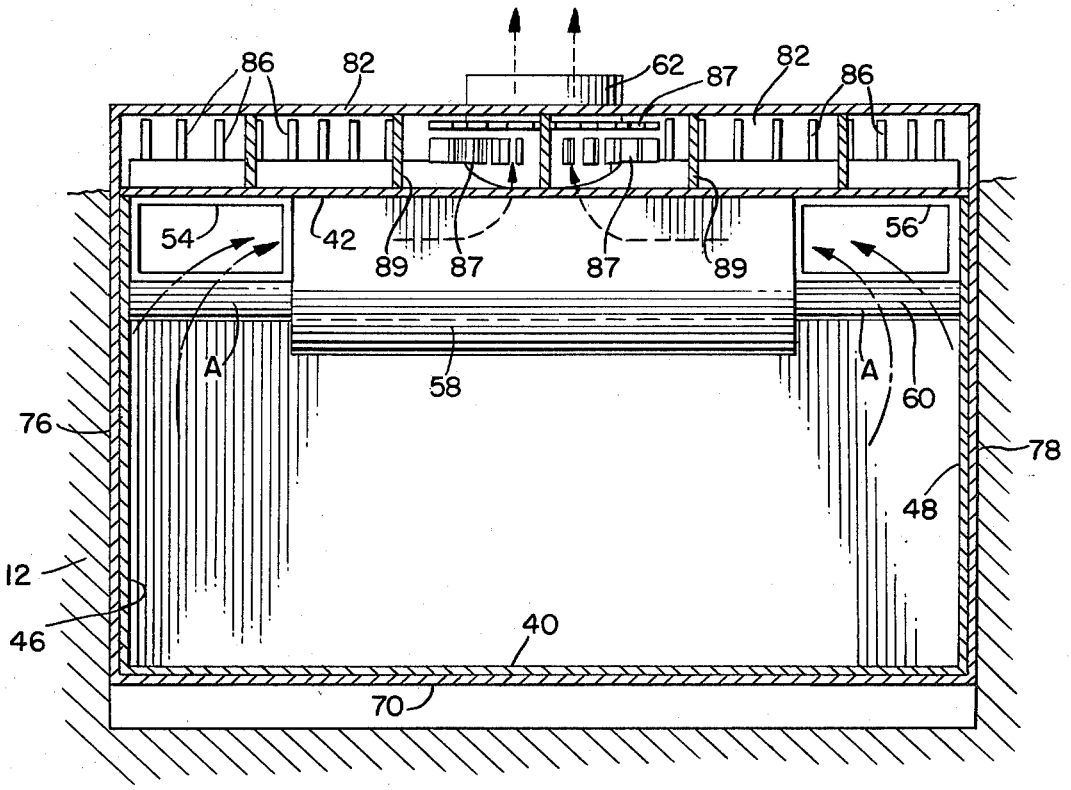
FIG. 4 is a front elevational view of the invention taken along lines 4—4 of FIG. 3 with the grate and wood burning logs removed for clarity.
Figure 5:
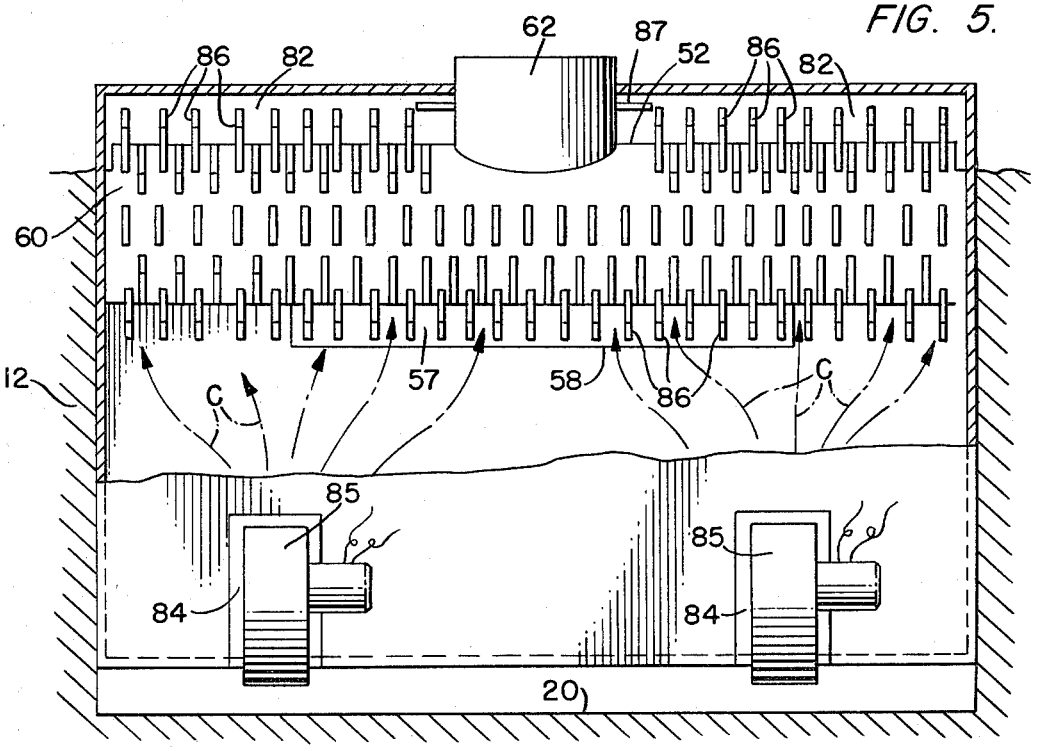
FIG. 5 is a rear elevational view of the subject invention taken along lines 5—5 of FIG. 3.

In accordance with the present invention, as shown in FIGS. 4 and 5, the top wall 42 and back wall 44 of the shell or combustion chamber, which would normally meet at the upward rear corner in a conventional stove, are terminated short of the corner to accommodate on air or combustion products exit manifold 52. Manifold 52 extends across the entire width of the combustion chamber and has its opposite end suitably affixed to the side walls 46 and 48 and to top wall 42 and back wall 44 by welding or the like. Manifold 52 includes a pair of inlet openings 54 and 56 disposed at opposite sides of the manifold and adapted to provide inlet passages for combustion products. Openings 54 and 56 are shown in FIGS. 2 and 4 as rectangular or box shaped conduits which extend out a short distance from the manifold surface. Between conduits 54 and 56 is welded a curved air deflection plate member 58 which is slightly spaced from the front and lower peripheral surface 60 of manifold 52. Plate member 58 may be welded at its dies to the sides of the conduits 54 and 56 and its bottom end to the top of back wall number 42 to establish a lower air passage 57 about manifold 52, an upper air passage 59 being defined by a portion of an auxiliary back wall 72 and a portion of an auxiliary top wall 76 and the back and upper surface of the manifold.

Manifold 52 is provided with an exit opening or circular pipe conduit 62 disposed centrally thereof and adapted to be connected to a flue 64. Flue 64 may include a conventional damper mchanism 66. Within the combustion chamber 11 and immediately in front of the manifold 52 and extending across the width of the chamber is a baffle 68. Baffle 68 extends downwardly from top wall 42 and is sloped at an angle towards the rear wall 44. Baffle 68 is designed to create a turbulence and to provide a tortuous path for the combustion products within fire chamber 11 as shown by the arrows A in FIG. 3 so as to prevent the combustion gasses or products from escaping directly through the inlet openings 56 and 58 of the manifold which, as viewed from the front of the stove, are disposed behind the baffle and at opposite sides of the fire chamber.

The combustion chamber or shell 11 and the manifold 52 which is an integral part thereof are disposed within an outer stove housing comprising a bottom support wall 70 an auxiliary rear wall back wall 72, an auxiliary top wall 74 and side walls 76 and 78. The auxiliary back wall 72 is spaced from shell back wall 44 to form an air chamber therebetween. Auxiliary top wall 74 is spaced from shell top wall 42 to form an air space therebetween. The two air spaces 80 and 82 are in communication with each other through air passages 57 and 59 so as to form a continuous passage. One or more air inlets 84 are provided in the lower portion of auxiliary back wall 72 and a suitable air or blower motor 85 is conveniently supported at each air inlet to draw air into the air passage. As shown by arrows B and C in FIGS. 2 and 3, cold air is drawn from below and behind stove 10 through inlets 84 and is directed upwardly through the air passage 80 over and under the manifold through passages 57 and 59 to air space 62.

It will be noted that the air drawn into the air chambers shown by arrows B is cold air which is heated as it passes over manifold 52. To this end, manifold 52 is provided with a plurality of heat extractors 86. The heat extractors are in the form of heat conductive strips arranged along the periphery of the manifold and extending outwardly therefrom. The strips 86 are disposed radially with their flat planar surfaces arranged parallel to a vertical plane and in the path of air movement to provide a minimum interference with air flow, but maximum planar surface for heat transfer. Spaced heat extractor strips 87 are also positioned on pipe conduit 62. The heat extractor strips 87 on conduit 62 comprise at least two rows disposed about the periphery of the pipe conduit. The uppermost row has its heat strips 87 disposed in a horizontal plane (flat surfaces horizontal) and radially of the pipe conduit while the lower row the heat strips are arranged at right angles with respect thereto (flat surfaces vertical). As the air comes up and over the heat strips, the heat strips of the lower most row present a minimum of interference with the air flow while the upper most row helps to deflect the air and redirect the air at right angles into the air chamber formed between walls 42 and 74, while still presenting a maximum surface for heat exchange purposes. The strips are approximately $1\times2\frac{1}{2}\times\frac{1}{8}$ inches spaced about one inch apart, and because of the great number thereof provide a relatively large cross section area of heat conductive metal for rapid extraction of heat from flowing combustion products. For example, on conduit 62, in a practical embodiment forty eight strips or heat vanes were placed around the outlet conduit and 106 strips about the main manifold surface. Of course, more strips can be used depending on available surface area.

As should be apparent, in operation, wood logs or other suitable fuel 88 may be positioned and burned on a grate 90 disposed in the fire chamber 11. The combustion gasses A rising from the burning fuel is caused, by virtue of baffle 68, to take a tortuous path finally passing under and about baffle 68 and into the air inlets 54 and 56 of manifold 52. The hot combustion products causes the manifold to be heated which heat is transferred to the cold air C through exterior strips 82 disposed about the periphery of the manifold 52 and stips 87 disposed about the periphery of the pipe conduit 62. The heat extracted from the combustion gasses is the heat that would normally flow with the flue gasses up the chimney and otherwise be wasted.

Additional heat transfer means in the form of longitudinal heat transfer plates 89 welded to the top wall 42 may be provided. These strips may have a plurality of openings 91 along the length and may be arranged at an angle with respect to the longitudinal axis to intercept the air flow, the openings 89 allowing air to pass through. In this way, a plurality of internal passages are formed in air space 84 with maximum exposure of metal to the air flow for maximum heat transfer.

A thermostat 71 may be provided to monitor the temperature of the air space entering the room to be heated with suitable control means responsive to the monitor temperature to control operation of the fan so as to reduce air circulation in the event of excessive heat. While the thermostat is shown positioned with its monitoring element 79 in air space 84, it should be apparent that thermostat 77 may be mounted anywhere in a room to be heated so as to monitor room temperature.

Figure 6:
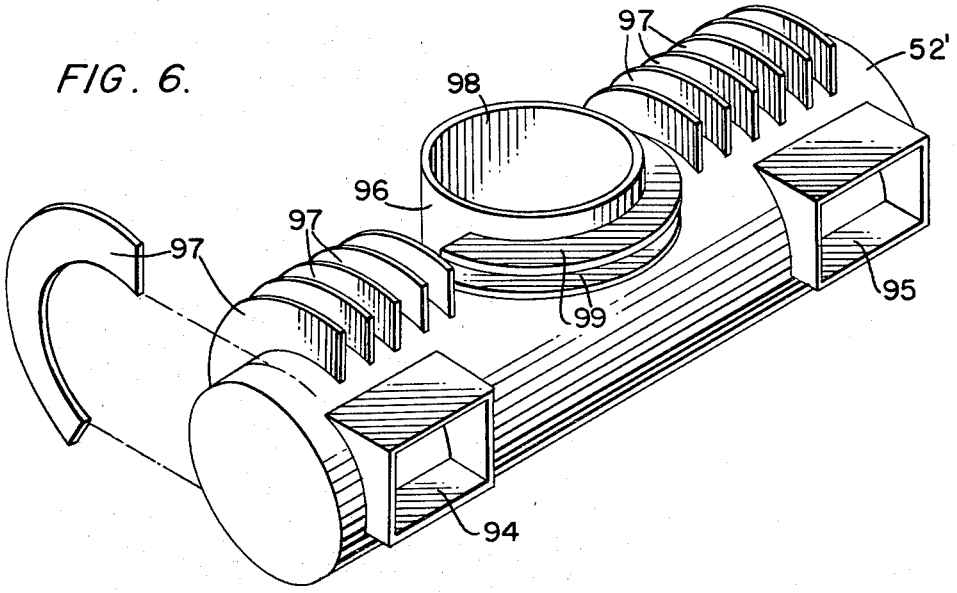
FIG. 6 is a perspective view of an alternate embodiment of an air outlet manifold for use in accordance with the present invention wherein the heating extracting strips are curved strip members affixed to the outer peripheral surface of the manifold and exit pipe.

Referring to FIG. 6, there is illustrated an alternate embodiment of manifold 52'. As in the case with the previously described embodiment, manifold 52' comprises a main cylindrical conduit comprising shell 93 closed at its opposite ends and having two inlet conduits 94 and 95 adapted to face into the combustion chamber. An outlet conduit 96 disposed between inlet conduits 94 and 95 provides an exit opening 98 adapted to be connected to the flue. Disposed about the periphery of the surface of the shell are a plurality of semicircular heat conducted strips 97. Similar semicircular heat conductive strips 99 are disposed about the outlet conduit 96. The strips 97 and 99 are arranged in spaced relationship to, in effect, provide a plurality of channels through which the cold input air passes and extracts heat from the strips. Although the strips 97 and 99 are shown only on the back surface of shell 93 and front surface of conduit 96, it should be apparent that for maximum heat transfer the strips can be positioned on both sides, i.e. all around the shell and conduit.

As should be apparent from the foregoing description, the heat extracting arrangement on manifold 52 provides substantially unobstructed passage for the cold air which is heat by the extraction of heat from the combustion gasses which would normally be wasted. The efficiency of the foregoing arrangement is manifested by the fact that with the stove in operation in accordance with the invention, the flue is normally warm to the feel of the hand, but can be grasped without danger of being burned.

While the heat extractor of the present invention has been illustrated and described in connection with a wood burning stove, it will be readily apparent to those skilled in the art that the heat extractor forms a separate article of manufacture readily adapted for installation at the flue outlet of any conventional heating system and is not limited for application to wood stoves. Accordingly, the foreging description is considered as illustrative only of the principles of the invention. Numerous modifications and changes will be readily aparent to those skilled in the art, it is not desired to limit the invention to the exact construction and operation shown and described. Rather, the invention includes all such modifications and equivalent which fall within the true spirit and full scope of the disclosure, as defined by the appended claims to which reference should be made.

I claim:

1. A wood stove including in combination:

a combustion chamber having front, back, top, bottom and side walls, and an air deflection member supported to said back and top walls;

an outer shell enclosing said combustion chamber including an auxiliary back wall spaced from said back wall to provide a first rearward airspace between said back wall and said auxiliary back wall for passage of air to be heated, a back air inlet in said auxiliary back wall adjacent the bottom of said airspace for the entry of air into said airspace, and an auxiliary top wall spaced from said top wall to provide a second air space between said top wall and said auxiliary top wall for passage of heated air into a room to be heated;

a heat transfer chamber supported between said outer shell and said air deflection member;

a manifold (52) positioned in said heat transfer chamber and extending thereacross;

first and second air passages disposed on opposite sides of said manifold and connecting said first and said second airspace through said heat transfer chamber to establish a continuous passage for air from said inlet into the room to be heated;

a plurality of spaced heat conductive strips extending radially outward from the surface of said manifold, said manifold having at least one air inlet communicating with an associated opening in said deflection member and leading into the combustion chamber for entry of combustion gases and an outlet opening for exit of the combustion gases, said heat conductive strips being disposed in said first and said second air passages;

a baffle plate in said combustion chamber and depending from said top wall and positioned so as to inrease the turbulence of combustion products and direct the exit of said products from the combustion chamber around the baffle plate as these products rise therefrom, said baffle plate extending across the combustion chamber and spaced forward of said manifold and deflection member;

a flue opening located in said auxiliary top wall substantialy centered above the exit opening of the manifold for forming an outlet for the products of combustion;

said front wall having a rectangular opening for permitting access to the combustion chamber; and a door pivotally attached to one side of the rectangular opening in said front wall and adapted to be pivoted between a closed and an open position for controlling access to the combustion chamber.

2. A wood stove as set forth in claim 1 wherein said manifold includes an exit conduit extending from said outlet opening, said exit conduit having a plurality of heat conductive strips disposed thereabout and extending radially outward thereof in said first and second air passages.

3. A wood stove as set forth in claims 1 or 2 wherein the heat conductive strips are in the form of flat rectangular strips spaced radially about said manifold and said exit conduit.

4. A wood stove as set forth in claim 3 wherein the heat conductive strips on the exit conduit are disposed in two rows, the strips of the uppermost row being disposed with their flat surfaces substantially horizontal, the strips of the lower most row being disposed with their flat surfaces substantially vertical.

5. A wood stove as set forth in claim 1 wherein said air deflection member is curved and supported in spaced relationship to the forward surface of said manifold and forward thereof so as to define said second air passage along the lowermost surface of the manifold, said second air passage opening at one end into the first air space and at its other end into the second air space.

6. A wood stove as set forth in claims 1 or 2 wherein said spaced heat conductive strips comprise flat curved elements connected to the surface of said manifold and extending radially outward across a portion of the curved surface of the manifold to provide a plurality of channels between the strips for passage of air from said first air space to said second air space.

7. A wood burning stove comprising a combustion chamber for burning wood, said combustion chamber being in the form of a shell defined by inner walls of the stove and having a rearwardly disposed outlet for combustion gases, outer auxiliary back, top and side walls spaced from corresponding shell walls to form therebetween air passages through which ambient air is recirculated into a room to be heated, a heat-extracting gas outlet manifold having a plurality of spaced heat conductive metal strips disposed about its periphery and having combustion gas inlets connected to said outlet and a combustion gas exit, and ambient air inlet at the bottom of the back air passage and an electric fan or blower attached to the inlet to force air into the air passages, said forced air being directed to pass upwardly in the space between the walls and both over and under the gas outlet manifold and past the heat conductive metal strips, through a top air passage formed between the top wall which extends across the combustion chamber and the auxiliary top wall and then exits through an upper grill work provided in the front face of the stove and into the space to be heated, additional heat conductive metal strips being disposed in the top air passage, said additional strips being connected directly to the top wall of the combustion chamber to extract heat therefrom prior to discharge of the forced air into the space to be heated, and a baffle in the combustion chamber disposed to create turbulence and to provide a tortuous path for the combustion products within the fire chamber so as to prevent the combustion gases or products from escaping directly through the inlet openings of the manifold to the flue.

8. A wood burning stove as set forth in claim 7 wherein said additional strips extend front to back on said top wall and are spaced from each other to form channel passages directing the gases to the grill work, said additional strips including a plurality of openings along the length thereof forming interconnecting internal passages between the channel passages and crosswise thereof.

9. A wood burning stove as set forth in claim 7 wherein said manifold includes an exit conduit extending from said gas exit, said exit conduit having a plurality of heat conductive strips disposed thereabout, said heat conduction strips being in the form of flat srips extending radially from said manifold and said exit conduit and being arranged perpendicularly to the heat conducting strips disposed about the periphery of the manifold.

10. A wood burning stove as set forth in claim 9 wherein the heat conductive strips on the exit conduit are disposed in two rows, the strips of the uppermost row being disposed with their flat surfaces substantially horizontal, the strips of the lower most row being disposed with their flat surfaces substantially vertical.

11. A wood burning stove as set forth in claim 9 wherein said space heat conductive strips comprise flat curved elements connected to the surface of said manifold and the surface of the exit conduit to provide a plurality of channels between the strips for passage of air therebetween.

* * * * *